US006560826B2

(12) United States Patent
Sekanina

(10) Patent No.: US 6,560,826 B2
(45) Date of Patent: May 13, 2003

(54) CLASP FOR ASSEMBLING TWO FLEXIBLE STRANDS ABLE TO BE USED, IN PARTICULAR, FOR A WATCH WRISTBAND

(75) Inventor: David Sekanina, Zürich (CH)

(73) Assignee: The Swatch Group Management Services AG (CH)

( * ) Notice: Subject to any disclaimer, the term of this patent is extended or adjusted under 35 U.S.C. 154(b) by 0 days.

(21) Appl. No.: 09/963,417

(22) Filed: Sep. 27, 2001

(65) Prior Publication Data

US 2002/0035767 A1 Mar. 28, 2002

(30) Foreign Application Priority Data

Sep. 28, 2000 (CH) ..... 1894/00

(51) Int. Cl.[7] ..... A44B 11/22
(52) U.S. Cl. ..... 24/176; 24/265 WS
(58) Field of Search ..... 24/186, 188, 175, 24/176, 178, 180, 179, 191, 163 R, 587.12, 173, DIG. 43, 174, DIG. 44, 177, 265 WS, 68 J, 68 E, 70 J, 69 J, 71 J

(56) References Cited

U.S. PATENT DOCUMENTS

| | | | | |
|---|---|---|---|---|
| 328,936 | A | * | 10/1885 | Hardy |
| 339,528 | A | * | 4/1886 | Cramer et al. |
| 961,823 | A | * | 6/1910 | Welch |
| 988,078 | A | * | 3/1911 | Carter |
| 1,487,577 | A | * | 3/1924 | Kerngood |
| 4,023,240 | A | | 5/1977 | Rieth |
| 4,727,628 | A | * | 3/1988 | Rudholm |
| 5,205,021 | A | * | 4/1993 | Durand |

FOREIGN PATENT DOCUMENTS

| | | |
|---|---|---|
| CH | 443755 | 9/1967 |
| CH | 454513 | 4/1968 |
| CH | 530189 | 11/1972 |
| FR | 2099102 | 3/1972 |

* cited by examiner

*Primary Examiner*—James R. Brittain
(74) *Attorney, Agent, or Firm*—Sughrue Mion, PLLC

(57) ABSTRACT

The present invention concerns a clasp (4) for assembling first and second flexible strands (1, 2) including a buckle (6) attached to the first (1) of the two strands, while the second strand (2) penetrates the buckle (6), characterised in that the buckle (6) includes fixed catching means (14) which are caught in the second strand (2), and in that it includes an unlocking device (22) able to be actuated manually, this unlocking device (22) allowing the second strand (2) to be raised to release it from the catching means (14) and to slip it out of the buckle (6).

20 Claims, 5 Drawing Sheets

CLASP FOR ASSEMBLING TWO FLEXIBLE STRANDS ABLE TO BE USED, IN PARTICULAR, FOR A WATCH WRISTBAND

BACKGROUND OF THE INVENTION

The present invention concerns a clasp for assembling two flexible strands, for example made of leather or a synthetic material. Such a clasp may be used, for example, for a watch strap or wristband, or a belt.

In known clasp devices for assembling flexible strands, the strands include holes provided to receive a tongue when they are assembled. This conventional construction has, however, the drawback that said strands break easily, generally where the hole receiving the tongue is located, because of the fatigue to which such strands are subjected.

Wristbands or bracelets, particularly those which are fitted to watches, need to be able to be closed on the wrist easily and without there being a risk that the watch can slip away when one tries to form the fastening loop. For this reason, the wristband can be continuous so that it remains securely on the wrist.

A first known solution relates to wristbands formed of contiguous metal segments which contain small springs which allow the wristband to be extended when it is pulled. In order to be able to work, such a solution however requires very small springs subject to fatigue and which have a limited life time.

In order to overcome this drawback, claps with multiple articulated hinges have been proposed, these claps being essentially mounted on metal bracelets with two articulated but non-extending segments. This more advantageous solution was obtained with continuous devices with segments which are rigid, articulated, folding, able to be superposed and caught on each other. A very large number of models exists.

A model with three rigid segments may be cited as an example, the first of which closes under the second, while the third, acting as a cover, engages on the second and locks onto the first.

These conventional clasps with unfolding buckles have the advantage of preventing, to a certain extent, the wristband surreptitiously passing over the hand if a pulling force is exerted on the wristband. However, this type of clasp is relatively complicated and implements numerous parts, which makes it quite expensive.

A considerable improvement was made by the device disclosed in Swiss Patent No. 530,189 which proposed a construction which, while proposing a more attractive appearance, also improved the facility of fastening.

This device is formed of a clasp secured to one of the strands of a wristband and provided with means gripping the other strand of the wristband. This second strand is gripped between the base of the clasp and an eccentric end of a lever pivoting on the base of the clasp. The base plate of this clasp carries a rib which engages in one of the grooves made on the invisible face of the wristband intended to be in contact with the wrist of the person wearing the watch. Said base plate also carries a pin which engages in one of said grooves made on the invisible face of the wristband.

One advantage of this clasp lies in the fact that, in the embodiment described hereinbefore, the second strand engages under the first strand, which gives the wristband a very attractive appearance.

Another advantage is the great simplicity of construction of the clasp which allows its manufacturing costs to be substantially reduced. This clasp also has the advantage of being able to be fitted to any type of flexible wristband, for example of the Milanese or woven type, or those made of plastic material.

The clasp disclosed in Swiss Patent No. 530,189 has, however, a certain number of drawbacks from among the most important of which can be cited the fact that the pivoting lever which, via its eccentric end, grips the second strand of the wristband against the base of the clasp does not ensure that the wristband is firmly secured to the wearer's wrist. Indeed, an external pulling force can very easily cause the lever to pivot into the opening position and cause the wristband to pass over the hand without such action being desired by the wearer. This method thus reduces the confidence which this type of clasp can inspire.

On the other hand, as was described hereinbefore, the base plate of the clasp carries both a rib and a pin which each engage in one of the grooves made on the lower face of the wristband. Since there is nothing provided to raise the wristband in order to free the grooves from their grip with the rib and the pin, the wearer will encounter significant difficulties in slipping the second strand out of the clasp when he wishes to take the watch off. This operation is made all the more difficult by the fact that the wristband is engaged with the base plate, not at one point, but at two distinct points materialised by the rib and the pin.

Finally, by gripping the wristband against the base plate of the clasp, the eccentric lever has the effect of marking the surface of the wristband.

Swiss Patent No. 454,513 discloses a watch wristband including a clasp secured to one of the strands of the wristband and provided with means gripping the other strand of the wristband. The gripping means are formed by a slightly curved plate, having a bottom provided on each side, in the direction parallel to the length of the wristband, with a perpendicular edge. A bar fixed in the edges assures the connection of the clasp to one of the wristband strands. A cover is hinged on the gripping means and pivots about the same bar as that via which the clasp is connected to one of the strands. On each side, in the longitudinal direction to the length of the wristband, the cover has an edge. These edges are slightly inclined inwards, like the edges of the plate, so that when the cover is closed, a certain resistance has to be overcome, which prevents the cover being opened inadvertently. The plate has a projecting part directed upwards which is engaged in one of the grooves arranged in the invisible lower face of the second wristband strand. When the cover is open, the end of the second strand is engaged in an opening of the clasp. The second strand is then adjusted to the desired length, then the projecting part is engaged in one of the grooves. Finally, the cover is closed.

This embodiment has the major drawback of wearing out quickly and no longer assuring that the cover snap fits properly on the edges of the clasp plate. This is essentially due to a high snap fitting force and, therefor, rapid wear of the system. If the clasp cover is not closed properly, an external pulling force may very easily cause it to pivot, so that the user is liable to lose his watch.

SUMMARY OF THE INVENTION

On the other hand, there is nothing provided to raise the second wristband strand under the lower face of which are arranged the grooves in which the projecting part of the plate has to engage. The user is thus liable to experience great difficulty in sliding the two wristband strands in relation to each other, since one of the strands is liable to be held back by the projecting part engaged in the corresponding groove.

The object of the present invention is to overcome the aforementioned drawbacks in addition to others by proposing a clasp for assembling two flexible strands, able to be used for example for a watch wristband or a belt, this clasp being inexpensive to make and very easy and secure to use.

The present invention thus concerns a clasp for assembling a first and second flexible strands including a buckle attached to the first of the two strands while the second strand penetrates the buckle, characterised in that the buckle includes fixed catching means which are caught in the second strand, and in that it includes an unlocking device able to be actuated manually, this unlocking device allowing the second strand to be raised to release it from the catching means and to slip it out of the buckle.

As a result of these features, the present invention provides a clasp which is easy to use. Indeed, in order to assemble the flexible strands of the wristband or belt and to close the clasp, one need only engage the end of the second strand in the clasp, so that this end is placed above the catching means. The wristband strand is then adjusted to the desired length, then the catching means are caught on the strand. The wristband is thus securely held in place and is not liable to be opened inadvertently. In order to open the wristband, one need only actuate the locking device manually. On doing so, the unlocking device raises the second wristband strand to release it from the catching means, so that the wearer need only pull on this strand to slide it with respect to the first strand and release it from the buckle.

The clasp according to the invention also offers great operating security. Indeed, as described hereinbefore, when the catching means are caught in the second strand, it is impossible to pull the second strand backwards. The confidence which one can have in the clasp according to the invention is further increased by the fact that the clasp does not require any parts to grip or clamp the second wristband strand in order to immobilise it. Consequently, the user is not liable to lose his watch as is the case with clasps of the prior art provided with gripping or clamping parts which are able to open inadvertently at any time.

According to a complementary feature of the invention, the catching means include a tooth, and the unlocking device includes a lever mounted so as to move on the buckle and which is capable of raising the second strand.

The clasp according to the invention thus only includes two parts, namely the actual buckle which carries a tooth which catches in the second strand and which, if desired, may be made in a single piece with the buckle or constitute a separate part which will be fixed onto the buckle, and the unlocking device which allows the user to raise the strand in order to release it from the tooth. In addition to the fact that the clasp according to the invention is very simple to use, it also has the advantage of only using a small number of parts and thus being inexpensive to manufacture.

BRIEF DESCRIPTION OF THE DRAWINGS

Other features and advantages of the present invention will appear more clearly upon reading the following detailed description of an example of first and second embodiments of the clasp according to the invention, this example being given purely by way of non-limiting illustration, in conjunction with the annexed drawings, in which.

Figure 1:
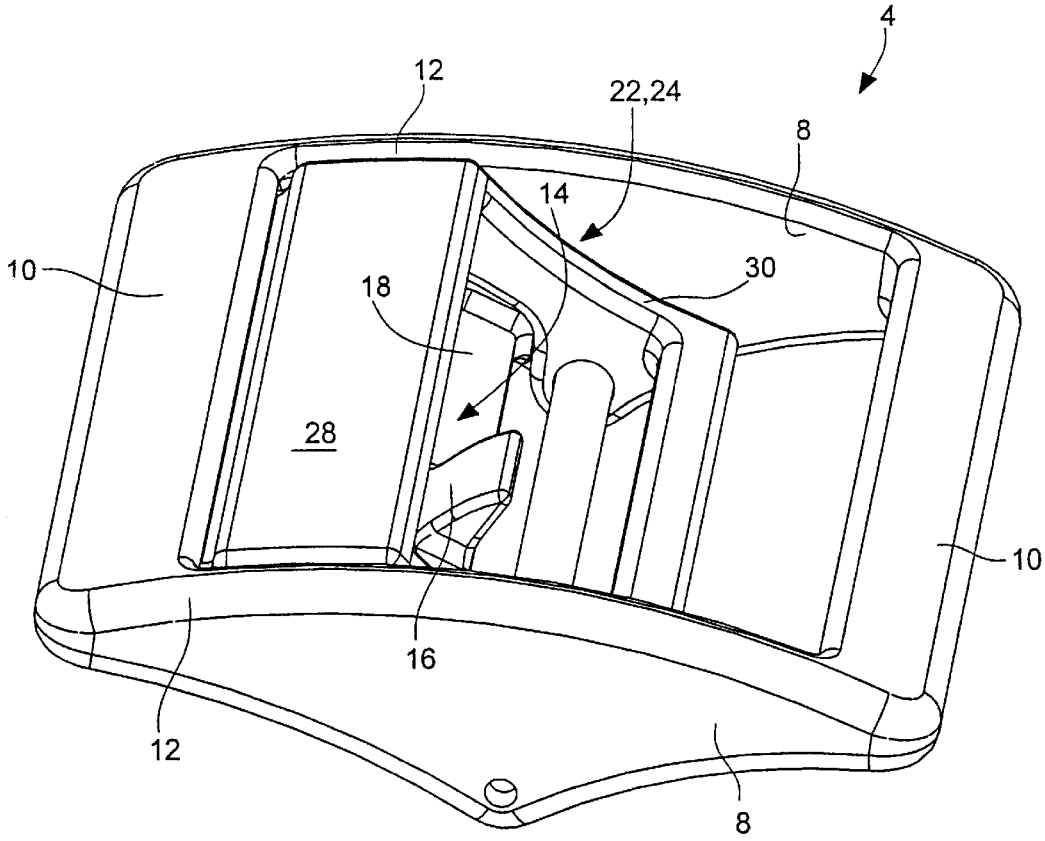
FIG. 1 is a perspective view of a first embodiment of the clasp according to the invention.

The present invention proceeds from the general inventive idea which consists in providing a clasp for assembling the two strands of a wristband or a belt which is simple to use and operates reliably, and which is also inexpensive to manufacture. The clasp according to the invention thus includes on the one hand catching means which are caught in the free strand of the wristband or belt to be assembled with the strand attached to the clasp, so that the two strands are securely held in place, without any risk of one of the strands moving in relation to the other. On the other hand, the clasp according to the invention includes an unlocking device which advantageously allows the free strand to be raised in order to free it from the catching means. The person wearing the wristband or belt can thus easily slip the second strand out of the buckle when he wishes to take off, for example, his watch. Finally, it is to be noted that the present clasp is formed of only two parts and is consequently inexpensive to manufacture. Further, it does not have any clamping or locking member to hold the strands assembled, which constitutes a definite advantage with regard to the clasps of the prior art, insofar as this type of locking member is liable, via the effect of an external pulling force, to open without the user wishing it do so.

A first embodiment of the invention is shown in FIGS. 1 to 4 and a second embodiment in FIGS. 4 to 8. In both cases, the Figures illustrate a partially shown wristband, approximately at the place opposite the watch, if the wristband is intended for a watch. In both these cases, the wristband is intended to be worn mainly around the wrist and includes a first flexible strand 1 and a second flexible strand 2 the first ends of which (not shown) are attached to the watch.

The present invention will thus be described with reference to a watch. It goes without saying however, that the present invention applies in the same way to a belt, to a bracelet carrying a jewel, or any other type of wristband or bracelet whose ends can be joined by a clasp according to the invention.

As shown in FIGS. 1 to 4, a clasp according to the present invention, designated as a whole by the general reference numeral 4, is essentially formed of a buckle 6 attached to the first flexible strand 1, while second flexible strand 2 penetrates buckle 6 to be assembled to first strand 1.

As is seen particularly in the perspective view of FIG. 1, buckle 6 includes two plates 8 which are parallel to each other and extend on either side of first and second strands 1 and 2, in a longitudinal direction to the length of strands 1 and 2. In order to rigidify buckle 6 and give it good mechanical resistance, the two plates 8 are connected at their ends by two crosspieces 10 transversal to said flexible strands 1 and 2.

It can also be seen in FIG. 1 that the two upper edges 12 of the two plates 8 have been given a curved shape which matches the curvature of the wearer's wrist.

According to the present invention, buckle 6 comprises fixed catching means 14 which catch in second flexible strand 2. Catching means 14 prevent second strand 2 from disengaging when the latter is engaged in buckle 6, in order to fix the wristband securely to the wrist on which it is worn.

In the embodiment shown in FIGS. 1 to 4, the catching means 14 take the form of a tooth 16 carried by a rib 18 which extends between the two plates 8 of buckle 6, perpendicular to the latter. According to a particularly advantageous embodiment, tooth 16, rib 18 which carries it and the two plates 8 of buckle 6 can be made in a single piece, for example by moulding or injection moulding of a plastic or metal material. According to another variant, tooth 16 and its rib 18 are manufactured separately and fixed between plates 8 of buckle 16 by any appropriate means, for example by bonding, ultrasound welding or screwing.

It will be noted that the invention is not limited to the use of a tooth. The catching means could consist, for example, of a small hook or a tip (not shown).

End part 19 of second strand 2 has on its lower face which is invisible to the wearer at least a milled portion forming a transverse groove 20 extending over a part of the total width of the wristband. This groove 20 has, for example, the shape shown in FIGS. 2 and 3, i.e. the shape of a groove of substantially triangular cross-section.

Tooth 16 carried by buckle 6 penetrates groove 20 via its upper end so as to lock second strand 2 securely, since no external pulling force can cause the object to pass over the hand without such action being desired by the wearer.

It will be noted that the security of clasp 4 according to the invention is further increased by the fact that tooth 16 is located at a higher level than the upper face of first strand 1. Second strand 2 which is introduced into buckle 2 has thus a curved profile which causes it to pass over said tooth 16, so that, when second strand 2 is released and the wearer's wrist relaxes, this causes said second strand 2 to move in the opening direction, as a result of which second strand 2 is stretched and tooth 16 is engaged still more firmly in groove 20 or the hole with which said tooth 16 is engaged.

Figure 2:
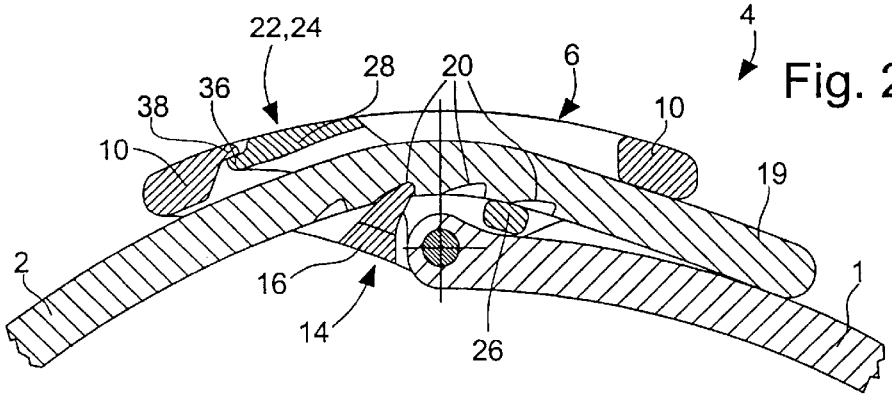
FIG. 2 is a cross-section of the clasp illustrated in FIG. 1, the unlocking device being in a rest position.
Figure 3:
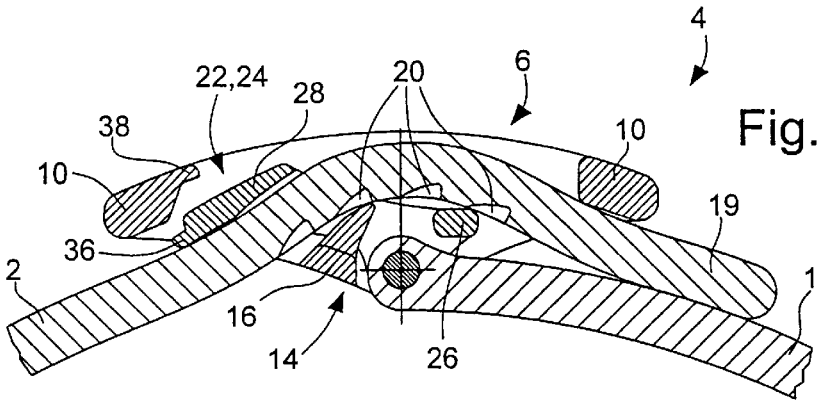
FIG. 3 is a cross-section of the clasp illustrated in FIG. 1, the unlocking device being in a folded position in which it raises the second wristband strand.
Figure 4:
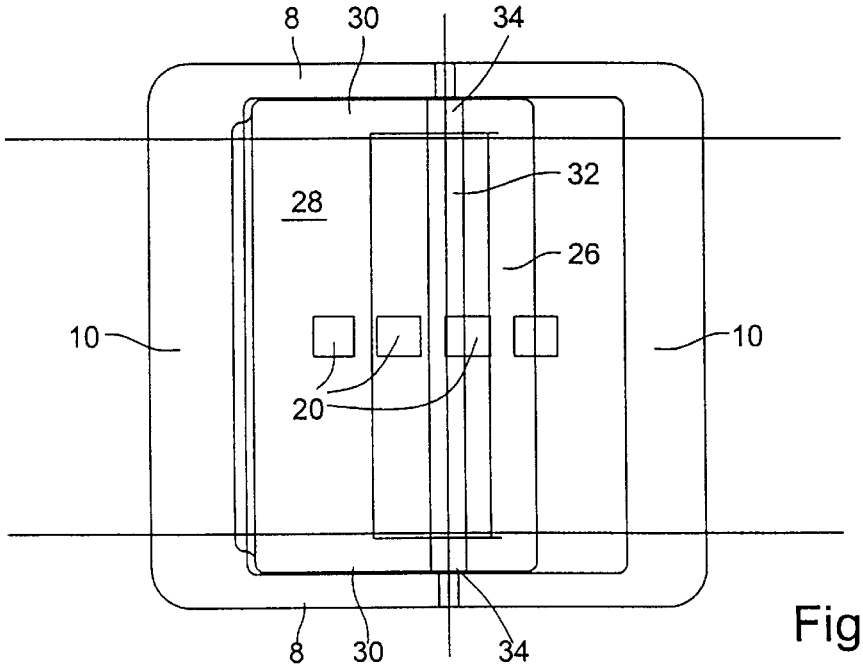
FIG. 4 is a plan view of the clasp of FIG. 1.
Figure 5:
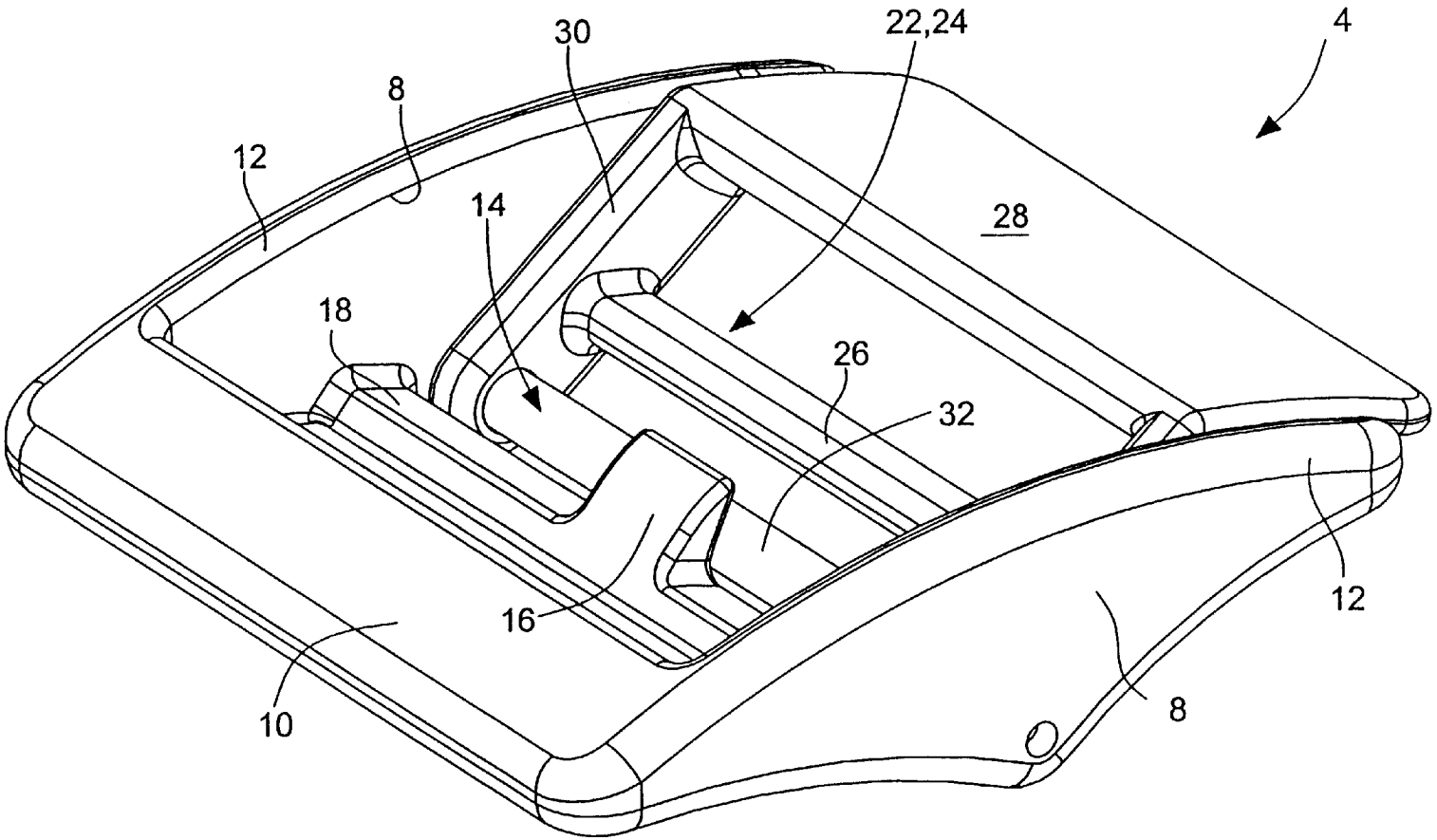
FIG. 5 is a perspective view of a second embodiment of the clasp according to the invention.

Until now, there has only been a single groove 20 for accommodating tooth 16 of buckle 6, this single groove 20 thus defining a single length of the wristband when second strand 2 is engaged in said buckle 6. However, several lengths may be desired to fit the different contours of a wrist. For this purpose, FIGS. 2 and 3 show a plurality of grooves 20 (four here) made in flexible second strand 2 and arranged along a row over a part of the total length of said second strand 2. Thus, tooth 16 can be introduced as desired in any of grooves 20 to fit the length of the wristband to the contour of the wrist wearing it.

Figure 9:
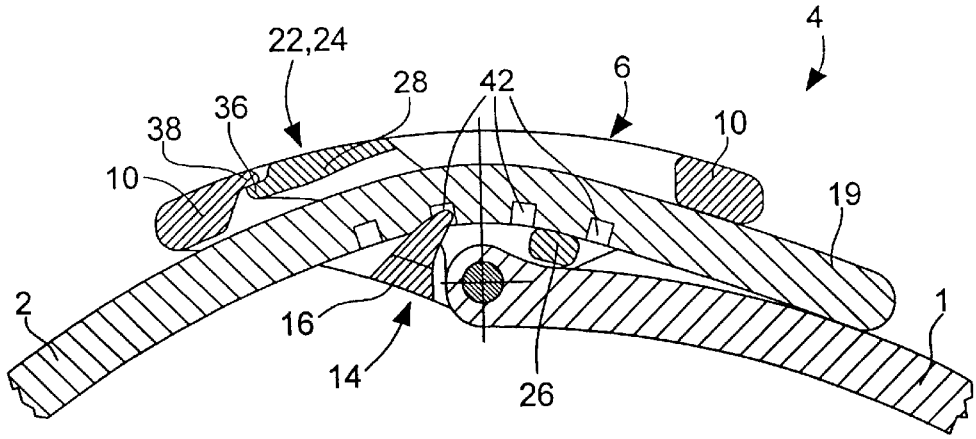
FIG. 9 is a cross-section, like FIG. 2, but with holes 42 instead of grooves 20.

According to a variant (FIG. 9), grooves 20 can be replaced by as many holes 42 pierced in end part 19 of second strand 2 and which tooth 16 can penetrate in order to lock said second strand 2 in a fastening position. However, it will be preferable to make grooves rather than holes in strand 2 insofar as grooves 20, made in the lower face of said strand 2, are invisible to the person wearing the wristband.

According to the present invention, buckle 6 also includes an unlocking device 22 able to be actuated manually, this unlocking device 22 allowing second strand 2 to be raised to release it from catching means 14 and to slip it out of buckle 6. Thus, after having actuated unlocking device 22, the person wearing the wristband need only pull on second strand 2 to cause it to slide with respect to first strand 1 and release it from buckle 6, without this operation being upset by tooth 16 being liable to remain caught in one of grooves 20 or holes made in said second strand 2.

Unlocking device 22 takes the form of a lever 24 mounted so as to move on buckle 6 and able to raise second strand 2. This lever 24 has a shape resembling that of a stretcher and is formed of a bar 26 for raising second strand 2 connected to an actuating plate 28 by two longitudinal arms 30. As can be seen in FIGS. 2 and 3, end part 19 of second strand 2 is passed above raising bar 26, so that the user need only press lightly on actuating plate 28 to raise said strand 2. Lever 24 is thus articulated so as to pivot on buckle 6 by means of a small bar 32 introduced into hinges 34 made in both plates 8 of buckle 6.

Advantageously, first strand 1 is wound to a fixed length around the same small bar 32 as that by which unlocking lever 24 is hinged so as to pivot on buckle 6.

In FIG. 2, clasp 4 according to the invention is shown in the closed state. Second strand 2 is engaged via its end part 19 in buckle 6 causing it to pass above raising bar 26 of unlocking lever 24. Tooth 16 is engaged in one of grooves 20 made in the invisible lower face of second strand 2. Actuating plate 28 has a transverse part 36 which abuts against an edge 38 of the opposite crosspiece 10, which limits the clearance of unlocking lever 24.

In FIG. 3, the user exerts a push on unlocking lever 24 which causes the lever to pivot around its shaft 32 and causes raising bar 26 to move upwards which raises second strand 2. Grooves 20 or holes 42 made in second strand 2 thus slip away from tooth 16 of buckle 6 and the user can withdraw said second strand 2 with respect to first strand 1 and remove it from buckle 6.

FIGS. 5 to 8 illustrate a second embodiment of clasp 4 according to the invention. In the following description, those elements which are identical to those previously described will be designated by the same reference numerals.

Figure 6:
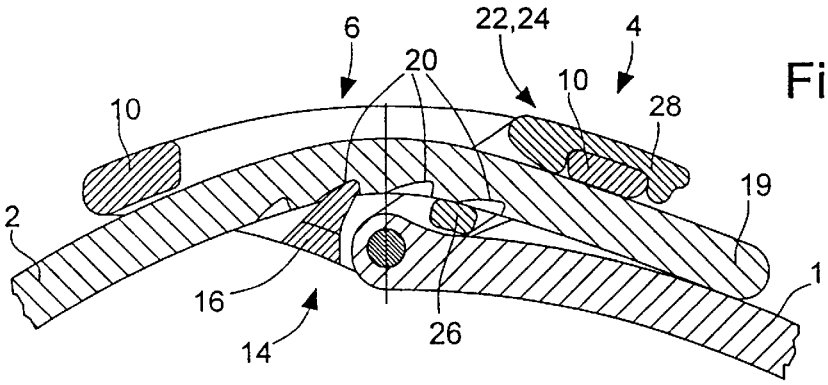
FIG. 6 is a cross-section of the clasp illustrated in FIG. 5, the unlocking device being in a rest position.
Figure 7:
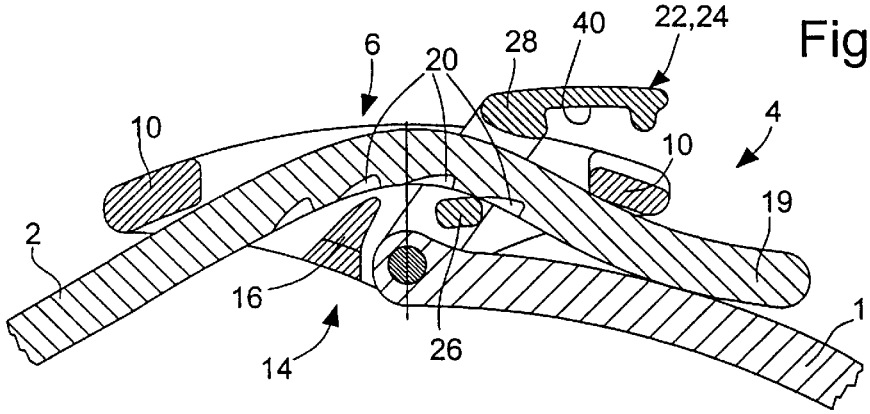
FIG. 7 is a cross-section of the clasp illustrated in FIG. 5, the unlocking device being in a raised position in which it raises the second wristband strand.
Figure 8:
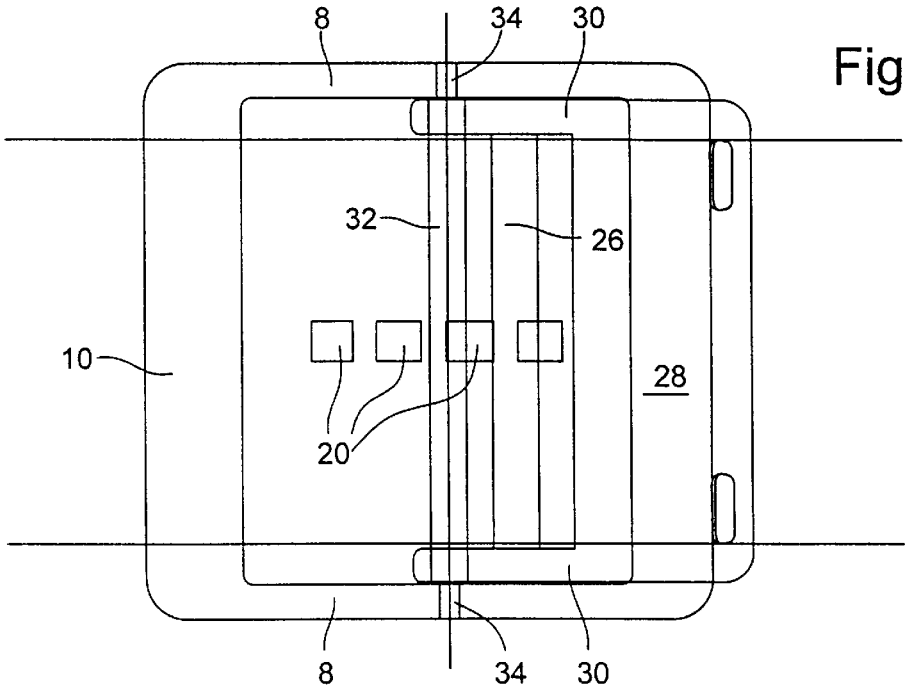
FIG. 8 is a plan view of the clasp of FIG. 2.

As can be seen very clearly, in particular in FIGS. 6 and 7, the second embodiment of clasp 4 according to the invention differs essentially from the first in that unlocking lever 24 is mounted in the opposite way on small bar 32. Thus, as is clear in FIG. 7, the user no longer has to push, but on the contrary has to pull unlocking lever 24 to cause it to pivot around small bar 32 and raise flexible second strand 2 which rests on raising bar 26. This second embodiment also differs from the first in that actuating plate 28 has a recess 40 under its surface arranged to cap crosspiece 10 of buckle 6 which is located facing recess 40. The assembly formed by recess 40 and the corresponding crosspiece 10 is made with limited play, so that a certain resistance has to be overcome when actuating plate 28 is folded down over crosspiece 10, which prevents unlocking lever 24 opening inadvertently.

The present invention can apply to any type of flexible wristband formed of strands, for example of the Milanese or woven type, or made of leather, rubber or synthetic material.

It goes without saying that the invention is not limited to the embodiments which have just been described, and that modifications and variants may be envisaged by those skilled in the art without departing from the scope of the present invention.

What is claimed is:

1. A clasp (4) for assembling first and second flexible strands (1, 2) including a buckle (6) attached to a first (1) of the two strands while the second strand (2) penetrates the buckle (6), characterised in that the buckle (6) includes fixed catching means (14) which are caught in the second strand (2), and in that the buckle further includes an unlocking device (22) able to be actuated manually, this unlocking device (22) having to be pushed in order to allow the second strand (2) to be raised to release it from the catching means (14) and to slip it out of the buckle (6).

2. Clasp according to claim 1, characterised in that the catching means (14) include a tooth (16), and in that the unlocking device (14) includes an unlocking lever (24) mounted so as to move on the buckle (6) and which is capable of raising the second strand (2).

3. A clasp according to claim 2, wherein the tooth and a rib which carries it are manufactured in a single piece with the buckle.

4. A clasp according to claim 2, wherein the tooth and a rib which carries it are manufactured separately and fixed to the buckle.

5. Clasp according to claim 2, characterised in that the unlocking lever (24) is articulated so as to pivot on the buckle (6).

6. Clasp according to claim 5, characterised in that the unlocking lever (24) is controlled by pressure to raise the second strand (2).

7. Clasp according to claim 2, characterised in that at least a transverse groove (20) in which the tooth (16) can be housed is arranged in the invisible lower face of the second strand (2).

8. Clasp according to claim 7, characterised in that the second strand (2) has a plurality of grooves (20) arranged along a row over a part of the total length of said second strand (2), so that the tooth (16) can be introduced as desired into one of the grooves (20) to fit the length of the first and second strands (1, 2) together attached to the contour of the wrist.

9. Clasp according to claim 8, characterised in that since the tooth (16) is located at a substantially higher level than the upper face of the first strand (1), the second strand (2) which is introduced into the buckle (6) has a curved profile which causes it to pass over said tooth (16), so that, when the second strand (2) is released and the wearer's wrist relaxes, this causes said second strand (2) to move in the opening direction, as a result of which said second strand (2) is stretched and the tooth (16) is engaged still more firmly in the groove (20) or the hole with which said tooth (16) is engaged.

10. Clasp according to claim 2, characterised in that at least a hole (42) in which the tooth (16) can be housed is pierced in the second strand (2).

11. Clasp according to claim 10, characterised in that the second strand (2) has a plurality of holes (42) arranged along a row over a part of the total length of said second strand (2), so that the tooth (16) can be introduced as desired into one of holes (42) to fit the length of the first and second strands (1, 2) together attached to the contour of the wrist.

12. Clasp according to claim 2, characterised in that the unlocking lever (24) includes a raising bar (26) above which the free end (19) of the second strand (2) passes, this raising bar (26) being connected to an actuating plate (28) by two longitudinal arms (30), the unlocking lever (24) being articulated so as to pivot on the buckle (6) by means of a small bar (32).

13. A clasp according to claim 12, wherein the first strand is wound to a fixed length around the small bar via which the unlocking lever is articulated so as to pivot on the buckle.

14. Clasp according to claim 12, characterised in that the buckle (6) includes two parallel plates (8) extending on either side of the first and second strands (1, 2) and connected to their ends by two crosspieces (10) transversal to said strands (1, 2).

15. A clasp according to claim 14, wherein the upper edges of the two plates of the buckle are given a curved shape which matches the curvature of the wrist.

16. Clasp according to claim 1, characterised in that the first and second strands (1, 2) are of the Milanese or woven type, or made of rubber, leather or a flexible synthetic material.

17. Clasp according to claim 14, characterised in that the unlocking lever (24) is controlled by pressure to raise the second strand (2), and the actuating plate (28) has a transverse part (36) which abuts against an edge (38) of the opposite crosspiece (10), which limits the clearance of the unlocking lever (24).

18. A clasp (4) for assembling first and second flexible strands (1, 2) including a buckle (6) attached to a first (1) of the two strands while the second strand (2) penetrates the buckle (6), characterised in that:

the buckle (6) includes fixed catching means (14) which are caught in the second strand (2), and in that it includes an unlocking device (22) able to be actuated manually, this unlocking device (22) allowing the second strand (2) to be raised to release it from the catching means (14) and to slip it out of the buckle (6);

the second strand (2) has a plurality of grooves (20) or holes (42) arranged along a row over a part of the total length of said second strand (2), so that a tooth (16) can be introduced as desired into one of the grooves (20) or one of the holes (42) to fit the length of the first and second strands (1, 2) together attached to the contour of the wrist; and since the tooth (16) is located at a substantially higher level than the upper face of the first strand (1), the second strand (2) which is introduced into the buckle (6) has a curved profile which causes it to pass over said tooth (16), so that, when the second strand (2) is released and the wearer's wrist relaxes, this causes said second strand (2) to move in the opening direction, as a result of which said second strand (2) is stretched and the tooth (16) is engaged still more firmly in the one groove (20) or the one hole with which said tooth (16) is engaged.

19. Clasp according to claim 18, characterised in that the unlocking device includes an unlocking lever (24) that is controlled by traction to raise the second strand (2).

20. Clasp according to claim 19, characterised in that the unlocking lever includes a raising bar above which the free end of the second strand passes, this raising bar being connected to an actuating plate by two longitudinal arms, the unlocking lever being articulated so as to pivot on the buckle by means of a small bar, the buckle including two parallel plates extending on either side of the first and second strands and connected to their ends by two cross pieces transversal to said strands, and in that the actuating plate (28) has, under its surface, a recess (40) arranged to cap the opposite crosspiece (10).

* * * * *